US008659441B2

(12) United States Patent
Wells

(10) Patent No.: US 8,659,441 B2
(45) Date of Patent: Feb. 25, 2014

(54) METHOD AND APPARATUS OF SENSING AND INDICATING AN OPEN CURRENT TRANSFORMER SECONDARY

(75) Inventor: Christopher D. Wells, McMurray, PA (US)

(73) Assignee: Eaton Corporation, Cleveland, OH (US)

( * ) Notice: Subject to any disclaimer, the term of this patent is extended or adjusted under 35 U.S.C. 154(b) by 94 days.

(21) Appl. No.: 13/553,888

(22) Filed: Jul. 20, 2012

(65) Prior Publication Data

US 2014/0022085 A1 Jan. 23, 2014

(51) Int. Cl.
*G08B 21/00* (2006.01)

(52) U.S. Cl.
USPC ..... 340/646; 340/635; 324/726; 361/35

(58) Field of Classification Search
USPC ..... 340/646, 635; 324/726; 361/35
See application file for complete search history.

(56) References Cited

U.S. PATENT DOCUMENTS

| | | | | |
|---|---|---|---|---|
| 5,179,489 | A * | 1/1993 | Oliver | 361/35 |
| 6,331,821 | B1 * | 12/2001 | Holce et al. | 340/635 |
| 7,193,428 | B1 * | 3/2007 | Baron et al. | 324/127 |
| 2009/0115400 | A1 | 5/2009 | Hunter | |

FOREIGN PATENT DOCUMENTS

| | | | |
|---|---|---|---|
| CA | 2216201 | A1 | 5/1999 |
| CN | 201570365 | U | 9/2010 |
| DE | 2605672 | A1 | 8/1977 |

OTHER PUBLICATIONS

European Patent Office, "International Search Report and Written Opinion", Jul. 5, 2013, 11 pp.

* cited by examiner

*Primary Examiner* — Eric M Blount

(74) *Attorney, Agent, or Firm* — Eckert Seamans Cherin & Mellott, LLC; Nathaniel C. Wilks

(57) ABSTRACT

An energy monitoring system for a power conductor includes a base unit; a sensor cable; and a current transformer electrically connected to the base unit by the sensor cable. The current transformer includes a secondary winding inductively coupled to the power conductor and a clamping circuit electrically connected in parallel with the secondary winding. The clamping circuit is structured to clamp a voltage across the secondary winding when the voltage across the secondary winding is greater than a predetermined value. An indicator circuit is electrically connected in series with the clamping circuit to indicate when the clamping circuit is actively clamping the voltage.

19 Claims, 4 Drawing Sheets

METHOD AND APPARATUS OF SENSING AND INDICATING AN OPEN CURRENT TRANSFORMER SECONDARY

BACKGROUND

1. Field

The disclosed concept pertains generally to current transformers and, more particularly, to current transformers for sensing current flowing in a conductor. The disclosed concept also generally pertains to energy monitoring systems for sensing current flowing in a conductor. The disclosed concept also generally pertains to methods for sensing current flowing in a conductor.

2. Background Information

Energy monitoring systems can monitor energy passing through one or more electrical conductors. A typical energy monitoring system includes one or more current transformers electrically connected to a base unit.

Current transformers of various types are generally known. Typically, a current transformer includes an annular iron core about which a plurality of turns of a number of windings are wrapped. In use, an electrical conductor is situated in the hole of the annular iron core, and when an alternating current is passed through the conductor, the conductor serves as a single turn primary winding to induce a current in the secondary winding. Depending upon the application, the secondary winding is electrically connected with a burden resistor of a base unit. The base unit senses a voltage across the burden resistor and responsively provides an output which may be, for instance, a measurement of the current. While current transformers and energy monitoring systems have been generally effective for their intended purposes, they have not been without limitation.

A dangerous or undesirable condition can arise when the secondary winding of the current transformer on an active primary load becomes open circuited. The open circuited condition may be caused by, for example, broken sensor wires between the current transformer and the base unit or unterminated sensor wires. The open circuited condition can cause the current transformer to output dangerous or undesirable voltage levels. Additionally, the open circuited condition prevents monitoring of the current of the active primary load.

In order to prevent the dangerous or undesirable voltage levels at the current transformer, a clamping circuit has been included in current transformers in order to limit the voltages levels at the current transformer. Although the clamping circuit prevents dangerous voltage levels at the current transformer, the open circuited condition will still prevent monitoring of the current of the active primary load.

The identification of the type and location of the error in the energy monitoring system requires the use of resources such as the time of a technician and/or the use of troubleshooting equipment. Moreover, in the case that the energy monitoring system includes a plurality of current transformers, troubleshooting resources are needed to even identify which one of the current transformers is not operating properly.

It thus would be desirable to provide an improved current transformer or energy monitoring system that overcome these and other shortcomings associated with the relevant art.

SUMMARY

These needs and others are met by embodiments of the disclosed concept in which a current transformer is electrically connected with a base unit via a sensor cable. The current transformer includes a clamping circuit to clamp a voltage of a secondary winding and an indicator circuit electrically connected in series with the clamping circuit to indicate when the clamping circuit is active.

In accordance with one aspect of the disclosed concept, an energy monitoring system for a power conductor comprises: a base unit; a sensor cable; and a current transformer electrically connected to the base unit by the sensor cable, the current transformer comprising: a secondary winding inductively coupled to the power conductor; a clamping circuit electrically connected in parallel with the secondary winding, the clamping circuit being structured to clamp a voltage across the secondary winding when the voltage across the secondary winding is greater than a predetermined value; and an indicator circuit electrically connected in series with the clamping circuit to indicate when the clamping circuit is actively clamping the voltage.

In accordance with another aspect of the disclosed concept, a current transformer for a power conductor comprises: a secondary winding structured to be inductively coupled to the power conductor; a clamping circuit electrically connected in parallel with the secondary winding, the clamping circuit being structured to clamp a voltage across the secondary winding when the voltage is greater than a predetermined value; and an indicator circuit electrically connected in series with the clamping circuit to indicate when the clamping circuit is clamping the voltage.

In accordance with another aspect of the disclosed concept, a method of detecting and indicating an open circuit between a burden resistor and a secondary winding of a current transformer comprises: inductively coupling the secondary winding of the current transformer with a conductor; clamping a voltage across the secondary winding with a clamping circuit when the voltage is greater than or equal to a predetermined voltage; and indicating that the voltage is being clamped by an indicator circuit electrically connected in series with the clamping circuit. The indicator circuit may include a light emitting diode.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "electrical conductor" shall mean a wire (e.g., without limitation, solid; stranded; insulated; non-insulated), a copper conductor, an aluminum conductor, a suitable metal conductor, or other suitable material or object that permits an electric current to flow easily.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "clamping" shall mean limiting maximum and minimum values of a signal. For example, and without limitation, if an alternating current (AC) signal normally has a peak voltage of +/−10V and the AC signal is clamped at +/−5V, the clamped AC signal will not increase above +5V and will not decrease below −5V.

Figure 1:
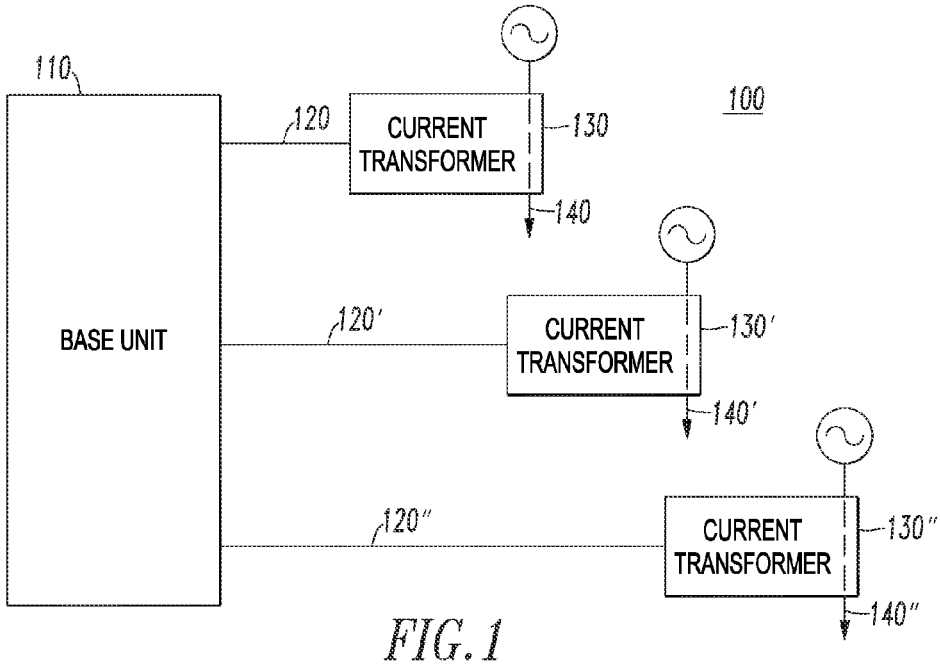
FIG. 1 is a block diagram of an energy monitoring system in accordance with embodiments of the disclosed concept.

Referring to FIG. 1, an energy monitoring system 100 is shown. The energy monitoring system 100 includes a base unit 110 electrically connected to first, second, and third current transformers 130, 130', 130" by first, second, and third sensor cables 120, 120', 120" (e.g., without limitation, twisted pair cables) respectively. Although FIG. 1 illustrates the base unit 110 electrically connected to three current transformers, the disclosed concept is not limited thereto. The base unit 110 can be electrically connected to any number of current transformers.

The first, second, and third current transformers 130, 130', 130" are inductively coupled to first, second, and third power conductors 140, 140', 140", respectively. The current flowing through the first, second, and third power conductors 140, 140', 140" induces currents in the respective first, second, and third current transformers 130, 130', 130". As such, the energy monitoring system 100, which is electrically connected to each of the current transformers 130, 130', 130", can monitor the current flowing through each of the first, second, and third power conductors 140, 140', 140", respectively.

Figure 2:
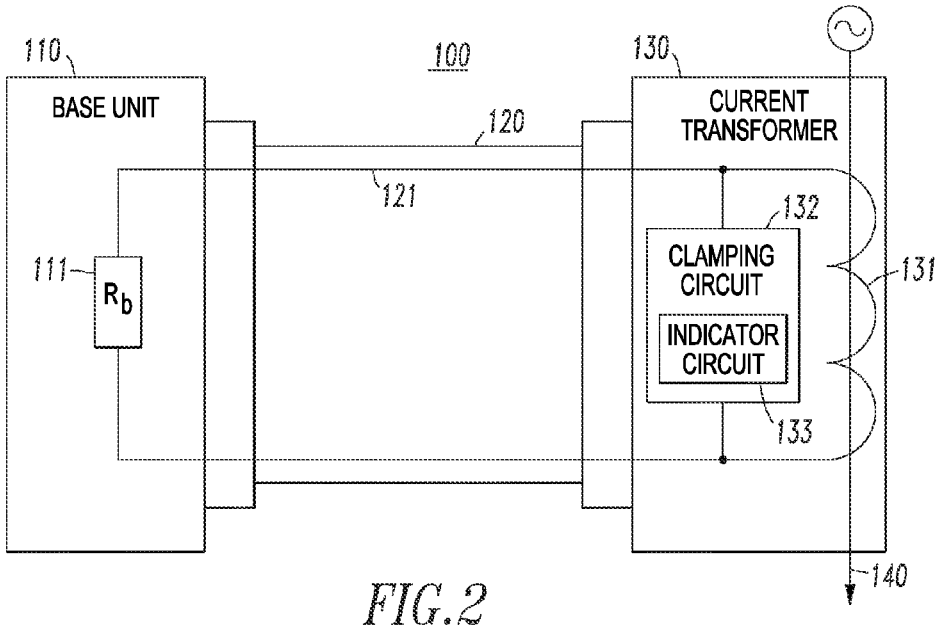
FIGS. 2 and 3 are block diagrams of an energy monitoring system in accordance with embodiments of the disclosed concept.
Figure 3:
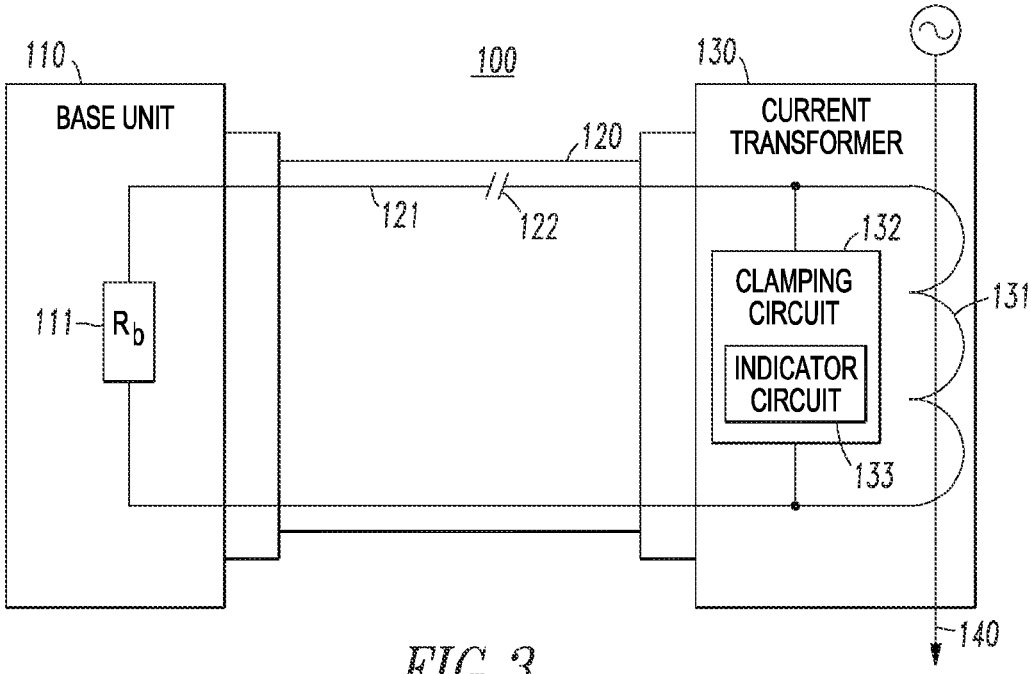

FIGS. 2 and 3 illustrate the energy monitoring system 100 including the base unit 110 and a current transformer 130 electrically connected by the sensor cable 120. To more concisely explain the disclosed concept, FIGS. 2 and 3 illustrate the base unit 110 electrically connected to a single current transformer 130. However, the disclosed concept is not limited thereto. The base unit 110 may be electrically connected to any number of current transformers and the features of the current transformer 130 can be included in one or more of the current transformers electrically connected to the base unit 110.

The base unit 110 includes a burden resistance ($R_b$) 111. The current transformer 130 includes a secondary winding 131 inductively coupled to the power conductor 140. The current transformer 130 also includes a clamping circuit 132. The clamping circuit 132 is electrically connected in parallel with the secondary winding 131 and clamps the voltage across the secondary winding 131 when the voltage is greater than a predetermined value. The clamped voltage can be greater than a maximum normal operating voltage of the secondary winding 131. The clamping circuit 132 includes an indicator circuit 133 that is configured to indicate when the clamping circuit 132 is actively clamping the voltage across the secondary winding 131.

Referring to FIG. 2, the burden resistance 111 is electrically connected to the secondary winding 131 by a sensor conductor 121 included in the sensor cable 120. Referring to FIG. 3, there is a break 122 in the sensor conductor 121 causing the secondary winding 131 to become electrically disconnected from the burden resistance 111. When the secondary winding 131 becomes disconnected from the burden resistance 111, the voltage across the secondary winding 131 can increase to dangerous or undesirable levels. However, when the voltage across the secondary winding 131 reaches a predetermined value, the clamping circuit 132 clamps the voltage across the secondary winding 131. The indicator circuit 133 is configured to indicate when the clamping circuit 132 is actively clamping the voltage across the secondary winding 131.

Figure 4:
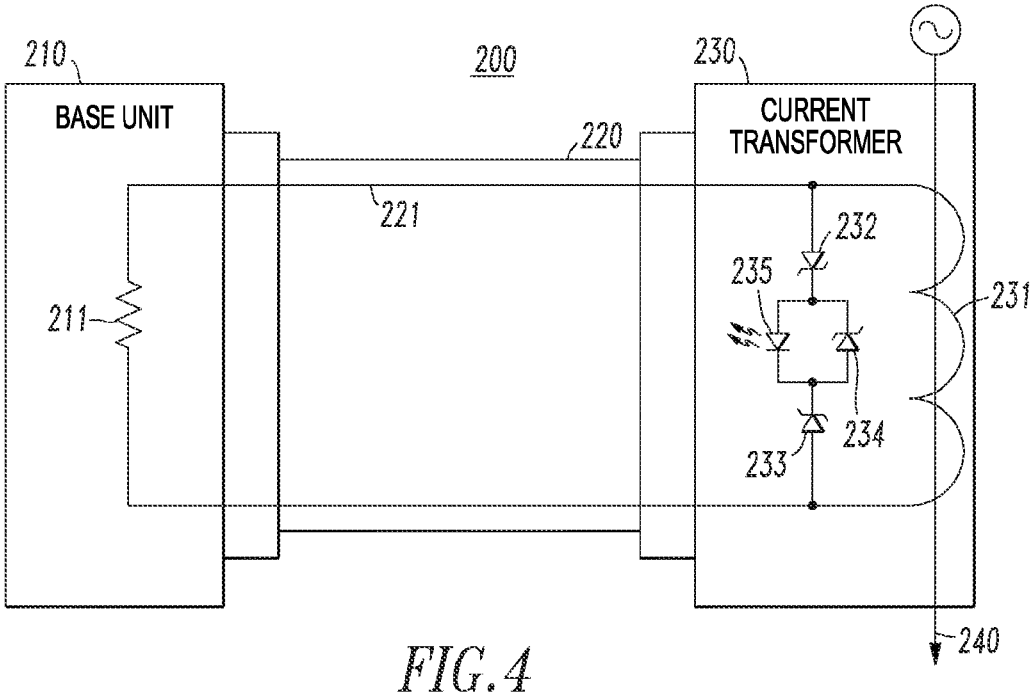
FIG. 4 is a circuit diagram of an energy monitoring system in accordance with another embodiment of the disclosed concept.

Referring to FIG. 4, an energy monitoring system 200 in accordance with example embodiments of the disclosed concept is shown. The energy monitoring system 200 includes a base unit 210 and a current transformer 230 electrically connected by the sensor cable 220. As shown in FIG. 4, the sensor cable 220 includes a sensor conductor 221 which electrically connects the current transformer 230 and the base unit 210.

The current transformer 230 includes a clamping circuit which includes a first zener diode 232 and a second zener diode 233 (e.g., without limitation, transient voltage suppression diodes) connected to terminals (not numbered) of the secondary winding 231. The current transformer 230 also includes an indicator circuit, which is a part of the clamping circuit, and includes a third zener diode 234 and a light emitting diode 235. The first zener diode 232 and the second zener diode 233 are electrically connected in series with the parallel combination of the light emitting diode 235 and the third zener diode 234. When the voltage across the secondary winding 231 becomes greater than a predetermined value, the clamping circuit clamps the voltage and the light emitting diode 235 turns on to indicate that the clamping circuit is active.

Continuing to refer to FIG. 4, the third zener diode 234 is electrically connected in parallel with the light emitting diode 235. The breakdown voltage of the third zener diode 234 is less than a maximum forward voltage of the light emitting diode 235. The forward voltage of the third zener diode 234 is substantially less than a maximum reverse voltage of the light emitting diode 235. As such, the third zener diode 234 provides protection, such as over current and reverse bias protection, for the light emitting diode 235.

Figure 5:
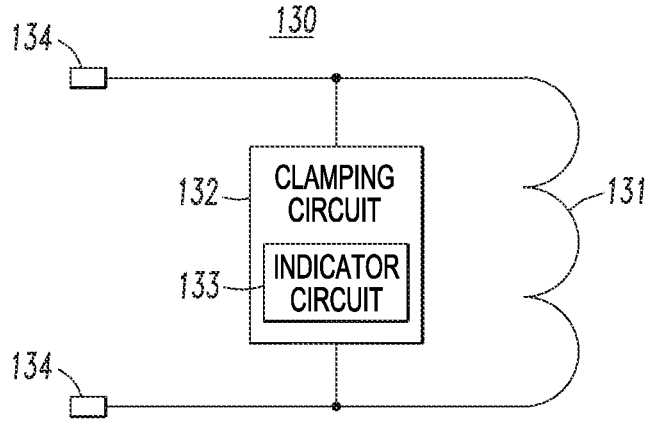
FIG. 5 is a block diagram of a current transformer in accordance with another embodiment of the disclosed concept.
Figure 6:
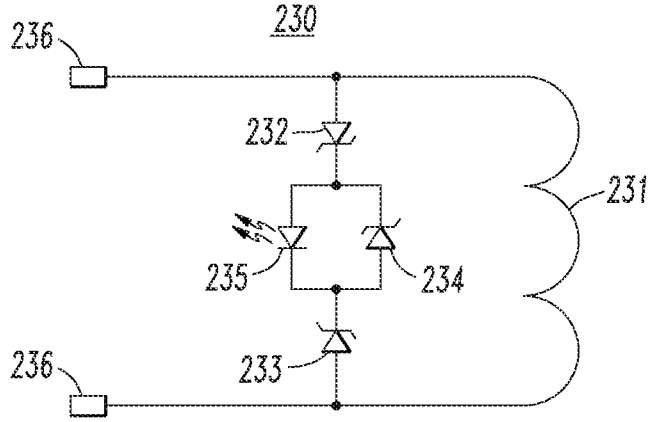
FIG. 6 is a circuit diagram of a current transformer in accordance with another embodiment of the disclosed concept.

FIGS. 5 and 6 illustrate current transformers according to other example embodiments of the disclosed concept. FIG. 5 illustrates a current transformer 130 similar to the current transformers 130 illustrated in FIGS. 1-3. However, the current transformer 130 shown in FIG. 5 is not connected to a base unit. The terminals 134 of the current transformer 130 can be used to electrically connect the current transformer 130 to an external unit, such as, for example, the base unit.

FIG. 6 illustrates a current transformer 230 similar to the current transformer 230 illustrated in FIG. 4. However, the current transformer 230 shown in FIG. 6 is not connected to a base unit. The terminals 236 of the current transformer 230 can be used to electrically connect the current transformer 230 to an external unit, such as, for example, the base unit.

Figure 7:
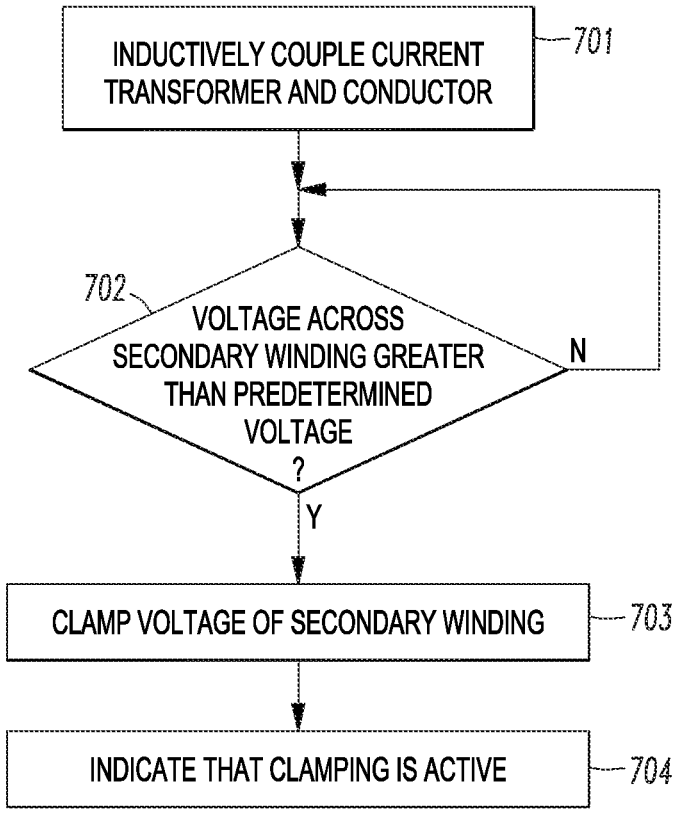
FIG. 7 is a flow chart of a method of detecting and indicating an open current transformer secondary in accordance with another embodiment of the disclosed concept.

Referring to FIG. 7, a method of detecting and indicating an open circuit between a burden resistor and a secondary winding of a current transformer is shown. A current transformer is inductively coupled to a load primary in operation 701. If the voltage across the secondary winding of the current transformer becomes greater than a predetermined value (operation 702), then the voltage across the secondary winding is clamped in operation 703. Otherwise, operation 702 is repeated. After operation 703, in operation 704, it is indicated that the voltage across the secondary winding is being clamped.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An energy monitoring system for a power conductor, said energy monitoring system comprising:

a base unit;

a sensor cable; and a current transformer electrically connected to the base unit by the sensor cable, the current transformer comprising:

a secondary winding inductively coupled to the power conductor;

a clamping circuit electrically connected in parallel with the secondary winding, said clamping circuit being structured to clamp a voltage across the secondary winding when said voltage across the secondary winding is greater than a predetermined value; and an indicator circuit electrically connected in series with the clamping circuit to indicate when the clamping circuit is actively clamping said voltage.

2. The energy monitoring system of claim 1, wherein the indicator circuit includes a light emitting diode.

3. The energy monitoring system of claim 1, wherein the sensor cable includes sensor conductors to electrically connect the secondary winding to the base unit; and wherein the clamping circuit clamps said voltage when the secondary winding is electrically disconnected from the base unit.

4. The energy monitoring system of claim 1, wherein the base unit includes a burden resistor electrically connected to the secondary winding by the sensor cable.

5. The energy monitoring system of claim 1, wherein the secondary winding includes a first terminal and a second terminal; and wherein the clamping circuit includes a first zener diode electrically connected to the first terminal of the secondary winding, and a second zener diode electrically connected to the second terminal of the secondary winding.

6. The energy monitoring system of claim 5, wherein the first and second zener diodes are transient voltage suppression diodes.

7. The energy monitoring system of claim 5, wherein the indicator circuit includes a light emitting diode electrically connected in series with the first and second zener diodes, and a third zener diode electrically connected in parallel with the light emitting diode.

8. The energy monitoring system of claim 7, wherein a breakdown voltage of the third zener diode is less than a maximum forward voltage of the light emitting diode.

9. The energy monitoring system of claim 7, wherein a forward voltage of the third zener diode is substantially less than a maximum reverse voltage of the light emitting diode.

10. The energy monitoring system of claim 1, wherein the clamped voltage across the terminals of the secondary winding is greater than a maximum normal operating voltage of the secondary winding.

11. The energy monitoring system of claim 1, wherein the sensor cable is a twisted pair cable.

12. A current transformer for a power conductor, said current transformer comprising:

a secondary winding structured to be inductively coupled to the power conductor;

a clamping circuit electrically connected in parallel with the secondary winding, said clamping circuit being structured to clamp a voltage across the secondary winding when said voltage is greater than a predetermined value; and an indicator circuit electrically connected in series with the clamping circuit to indicate when the clamping circuit is clamping said voltage.

13. The current transformer of claim 12, wherein the secondary winding includes a first terminal and a second terminal; and wherein the clamping circuit includes a first zener diode electrically connected to the first terminal of the secondary winding, and a second zener diode electrically connected to the second terminal of the secondary winding.

14. The current transformer of claim 12, wherein the first and second zener diodes are transient voltage suppression diodes.

15. The current transformer of claim 13, wherein the indicator circuit includes a light emitting diode electrically connected in series with the first and second zener diodes, and a third zener diode electrically connected in parallel with the light emitting diode.

16. The current transformer of claim 15, wherein a breakdown voltage of the third zener diode is less than a maximum forward voltage of the light emitting diode.

17. The current transformer of claim 15, wherein a forward voltage of the third zener diode is substantially less than a maximum reverse voltage of the light emitting diode.

18. The current transformer of claim 12, wherein the clamped voltage across the secondary winding is greater than a maximum normal operating voltage of the secondary winding.

19. A method of detecting and indicating an open circuit between a burden resistor and a secondary winding of a current transformer, the method comprising:

inductively coupling the secondary winding of the current transformer with a conductor;

clamping a voltage across the secondary winding with a clamping circuit when said voltage is greater than or equal to a predetermined voltage; and indicating that said voltage is being clamped by an indicator circuit electrically connected in series with the clamping circuit.

* * * * *